United States Patent [19]

Nilssen

[11] Patent Number: 4,626,747

[45] Date of Patent: Dec. 2, 1986

[54] CLASS-3 LIGHTING SYSTEM

[76] Inventor: Ole K. Nilssen, Caesar Dr., Barrington, Ill. 60010

[21] Appl. No.: 569,240

[22] Filed: Jan. 9, 1984

[51] Int. Cl.[4] ..... H05B 37/02; H05B 39/04; H05B 41/36

[52] U.S. Cl. ..... 315/209 R; 315/210; 315/161; 315/312; 362/148; 361/377

[58] Field of Search ..... 315/209 R, 210, 161, 315/312, 324, 146; 362/148; 363/146; 361/377; 307/82

[56] References Cited

U.S. PATENT DOCUMENTS

| | | | |
|---|---|---|---|
| 3,405,315 | 10/1968 | Moreland, II | 315/324 X |
| 4,293,799 | 10/1981 | Roberts | 315/324 X |
| 4,363,082 | 12/1982 | Roland | 362/148 |

FOREIGN PATENT DOCUMENTS

| | | | |
|---|---|---|---|
| 633937 | 1/1962 | Canada | 362/148 |
| 2089016A | 6/1982 | United Kingdom | 362/148 |

*Primary Examiner*—Saxfield Chatmon

[57] ABSTRACT

A lighting system for a suspended ceiling comprises a plurality of power conditioning units permanently wired-in with the 120 Volt/60 Hz power line and mounted in various suitable locations on the permanent ceiling above the suspended ceiling. Each such power conditioning unit provides a power-limited Class-3 high-frequency voltage at an output receptacle and is operable to power a special fluorescent lighting fixture by way of a light-weight flexible two-wire detachable connect cord. Special fluorescent lighting fixtures are mounted in the suspended ceiling, with each such lighting fixture being powered from a power conditioning unit mounted somewhere nearby on the permanent ceiling above. Due to the Class-3 power-limited nature of the output of each of the power conditioning units, as combined with the light-weight flexible and detachable nature of the connect cords, each special lighting fixture may be treated as a plug-in portable lighting product; which implies a particularly high degree of flexibility in installation and use. As a consequence of the high-frequency operation, the size and weight of the impedance matching means required in the special lighting fixture (to provide proper operation of the fluorescent lamp means therein) is very modest, which results in a particularly compact and light-of-weight lighting fixture.

19 Claims, 2 Drawing Figures

CLASS-3 LIGHTING SYSTEM

BACKGROUND OF THE INVENTION

1. Field of Invention

The present invention relates to a lighting system wherein the power to each of a plurality of lighting fixtures is provided in the form of a power-limited high-frequency voltage by way of a plug-in flexible light-weight cord from a remotely located permanently installed Class-3 power supply.

2. Description of Prior Art

Lighting systems for general purpose lighting normally consists of permanently wired-in lighting fixtures, with each lighting fixture obtaining its power directly from the regular power line. Since the amount of power available from such a regular power line is large enough to be considered dangerous from a fire-initiation viewpoint, it is required by the National Electrical Code that electrical conductors and other products connected directly with such a power line be made and/or installed in very special ways. For instance, electrical conductors typically have to be installed in the form of armored cable or within steel conduits.

As a result of the need for such protective measures, the powering of lighting fixtures directly from the power line must be done by relatively costly and inflexible means—with the net effective result that these lighting fixtures, once installed, become non-movable entities. Such non-movability, especially in connection with suspended ceiling systems, is a great limitation on the utility of the overall lighting system.

SUMMARY OF THE INVENTION

Objects of the Invention

A first object of the present invention is that of providing an improved and easy-to-install lighting system for general lighting purposes.

A second object is that of providing a lighting system comprising a plurality of lighting fixtures, and wherein each of these lighting fixtures can be installed and/or moved with particular ease and flexibility.

A third object is that of providing a fluorescent lighting system wheren each lighting fixture is powered by way of a light-weight, flexible and detachable cord means from a power-limited high-frequency voltage provided by a permanently installed power conditioning unit.

These as well as other objects, features and advantages of the present invention will become apparent from the following description and claims.

Brief Description

In the preferred embodiment, which relates to a suspended ceiling system, subject lighting system consists of a plurality of individual frequency-converting power conditioning units, each mounted on the permanent ceiling above the suspended ceiling and hard-wired to the electric utility power line. The output from each power conditioning unit is a relatively high-frequency (30 kHz) power-limited voltage; which output is limited to a maximum of 100 Volt-Ampere in accordance with specifications for Class-3 circuits (as defined by the National Electrical Code) and applied by way of a plug-in light-weight flexible two-wire electric connect cord to a special fluorescent lighting fixture mounted below in the grid of the suspended ceiling system.

Each of the power conditioning units is installed on the permanent ceiling in a location above an area in the suspended ceiling where a lighting fixture is apt to be needed.

The power-limited high-frequency voltage output from each power conditioning unit is available from a two-terminal female receptacle means capable of receiving a two-prong male plug means.

Each special fluorescent lighting fixture has a high-frequency voltage input receptacle in the form of a recessed two-prong male plug means capable of receiving a two-terminal female receptacle means.

Thus, by way of the light-weight flexible two-wire connect cord, which has a two-prong male plug means at its one end and a two-terminal female receptacle means at its other end, a special lighting fixture installed in the suspended ceiling can be connected with and powered from a power conditioner mounted on the permanent ceiling somewhere in the area above that lighting fixture's location in the suspended ceiling.

Due to the Class-3 power-limited nature of the output of each of the power conditioning units, as combined with the light-weight, flexible and detachable nature of the connect cords, each individual special lighting fixture may be treated as a plug-in portable lighting product.

In other words, in approximate net effect, subject system consists of special non-fixtured lighting fixtures whose ballasting means have been removed and permanently mounted externally of the fixtures and disconnectably connected with the fixtures by way of flexible two-wire connect cords.

DESCRIPTION OF THE PREFERRED EMBODIMENT

Description of the Drawings

Figure 1:
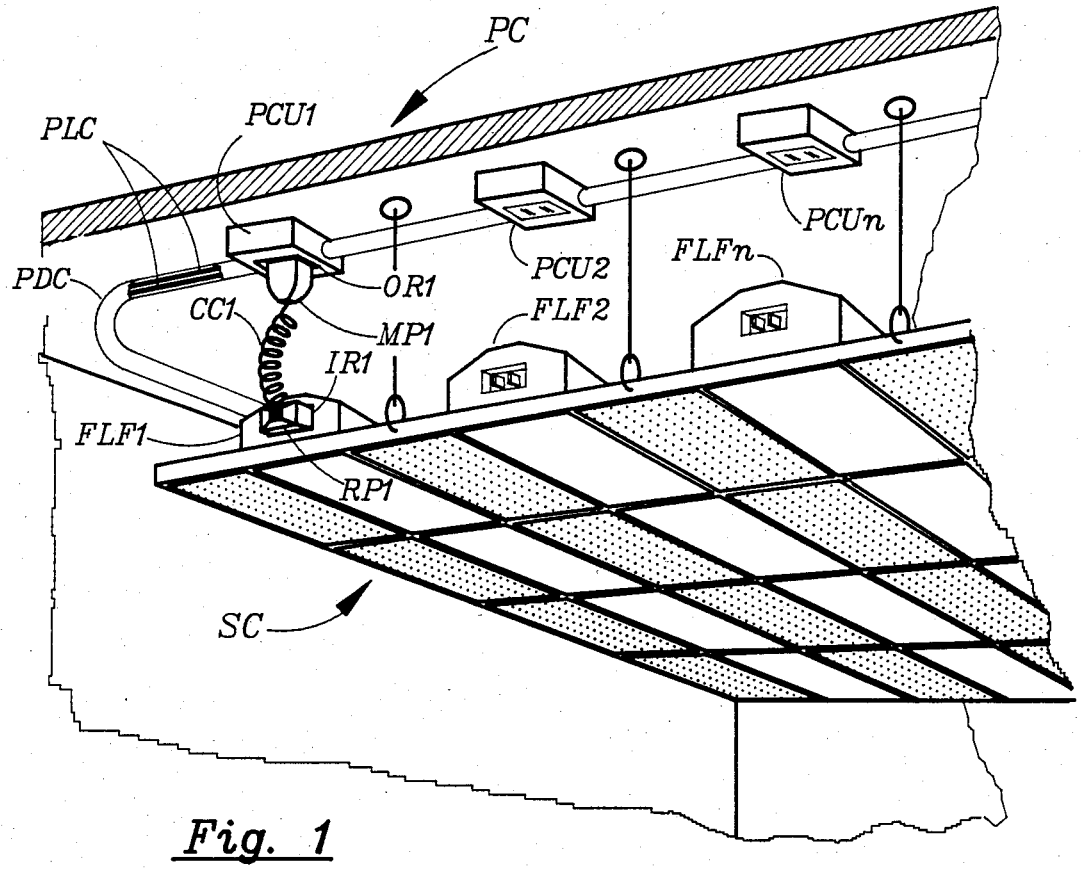
FIG. 1 illustrates from a systems viewpoint the preferred embodiment of the overall Class-3 lighting system of the present invention.

In FIG. 1, by way of a pair of power line conductors PLC within a power distribution conduit PDC mounted on and along the permanent ceiling PC above a suspended ceiling SC, ordinary non-power-limited 120 Volt/60 Hz voltage is provided by direct hard-wire connections to a plurality of power conditioning units PCU1, PCU2—PCUn; which power conditioning units are also mounted on the permanent ceiling.

Each power conditioning unit has a power output receptacle, such as OR1 of power conditioning unit PCU1. Plugged into OR1 is a two-prong male plug MP1 mounted at one end of light-weight flexible two-wire connect cord CC1.

Non-permanently mounted in the suspended ceiling is a plurality of fluorescent lighting fixtures FLF1, FLF2—FLFn; each of which has an input receptacle, such as IR1 on FLF1. Plugged into IR1 is a two-terminal female receptacle plug RP1, which is mounted at the other end of connect cord CC1.

Each of the fluorescent lighting fixtures is connected with a power conditioning unit by way of a connect cord such as CC1.

Figure 2:
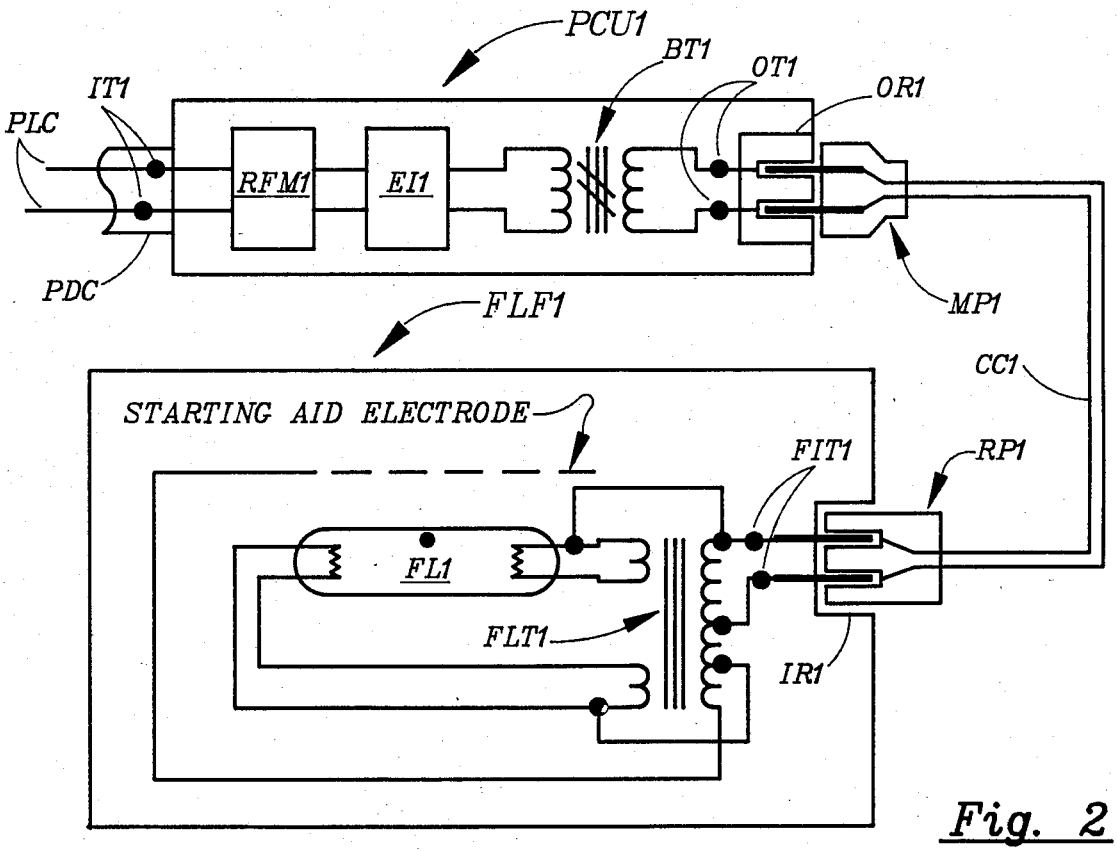
FIG. 2 shows electrical circuit details of a power conditioner unit as coupled with a special fluorescent lighting fixture.

FIG. 2 illustrates electrical circuit details of power conditioning unit PCU1 and fluorescent lighting fixture FLF1—showing the non-power-limited 120 Volt/60 Hz voltage from power line conductors PLC connected with input terminals IT1 or PCU1.

In PCU1, rectifier and filter means RFM1 is connected with input terminals IT1 and provides a DC voltage to electronic inverter EI1.

A current-limiting high-frequency ballasting transformer BT1 is connected in circuit between the output of inverter EI1 and output terminals OT1 of PCU1.

The power-limited high-frequency voltage provided at output terminals OT1 is applied by two-wire connect cord CC1 to input terminals FIT1 of fluorescent lighting fixture FLF1, which fixture includes a fluorescent lamp FL1 connected with input terminals FIT1 by way of fluorescent lamp transformer FLT.

Description of Operation

With reference to FIGS. 1 and 2, the operation of subject Class-3 lighting system may be explained as follows.

Non-power-limited 120 Volt/60 Hz voltage is provided to each one of the plurality of power conditioning units (such as to PCU1), which are non-disconnectably mounted on the permanent ceiling PC above the suspended ceiling SC.

Each power conditioning unit, by way of its rectifier and inverters means, converts the non-power-limited 120 Volt/60 Hz voltage to a 30 kHz substantially non-power-limited voltage; which 30 kHz non-power-limited voltage is then applied to a manifestly current-limiting transformer (i.e., a transformer with a substantial amount of leakage inductance). The output from this transformer is a power-limited 100 Volt/30 kHz voltage; which output is then applied to the power conditioning unit's output receptacle (such as OR1 in PCU1).

By way of disconnectable flexible cord means (such as CC1), each of the plurality of fluorescent lighting fixtures (such as FLF1) is connected with a power conditioning unit (such as PCU1), and is thereby provided with an input of power-limited 100 Volt/30 kHz voltage. This voltage is then, within each lighting fixture, applied to a fluorescent lamp transformer (such as FLT1), which transforms the 100 Volt/30 kHz input voltage to a voltage level appropriate for starting and operating the fluorescent lamp. Also, this fluorescent lamp transformer provides auxiliary outputs for low-voltage heating of the fluorescent lamp cathodes as well as for lamp starting aid.

To be acceptable in Class-3 applications, each of the plurality of power conditioning units has output characteristics conforming to the specifications provided for Class-3 circuits in Part C of Article 725 of the 1984 National Electrical Code.

Because of the Class-3 characteristics of the power conditioning units, the amount of power available from their output receptacles (such as OR1 on PCU1) is limited to a level considered acceptably safe from a fire initiation viewpoint. Yet, that amount of power—which may be as high as 100 Watt—is quite adequate to provide for ample light output from a fluorescent lighting fixture.

Due to the high-frequency operation, the fluorescent lamp transformer within each fixture (such as FLT1 in FLF1) can be extremely small and light-of-weight; which, especially when combined with the reduced fixture/structural requirements due to the Class-3 characteristics, permits the fluorescent lighting fixtures to be particularly compact and light-of-weight.

Thus, because of their Class-3 nature, the fixtures in subject lighting system may be considered as ordinary portable (plug-in) lighting products; which implies that they may be installed, moved, removed, and/or exchanged by unskilled persons.

And, because of their light weight, they are particularly easy to handle.

Concluding Comments

First, it is noted that Class-2 operation (as defined in Article 725 of the 1984 National Electrical Code) may be employed as a near-equivalent alternative to Class-3 operation.

Second, it is noted that subject power conditioning units may be part of and/or comprised within substantially ordinary junction boxes.

Third, except for Class-2 operation, it is noted that there is no basic need for the ballasting transformers in the power conditioning units to have isolated secondary windings.

Fourth, in order to provide a Class-3 lighting system, it is noted that it is not fundamentally necessary for the power conditioning units to provide frequency conversion. Rather, it would be possible—although generally not very advantageous—to have the power conditioning units provide 60 Hz power-limited output and to make the fixtures operate on 60 Hz input.

Fifth, it is noted that subject Class-3 lighting system is not limited to be used with fluorescent lighting fixtures. Rather, it may just as well be used with H.I.D. and/or incandescent lighting fixtures.

Sixth, it is noted that, while two-wire connection between the power conditioning units and the fluorescent lighting fixtures is advantageous as compared with multi-wire connection, it is definitely not a requirement for achieving Class-3 status.

Seventh, it is noted that the term "lighting fixture" as used herein does not necessarily refer to a permanently installed (or fixtured) lighting product, but rather refers more generally to a lighting means of a type capable of holding a one or more incandescent, fluorescent and/or H.I.D. lamps, and suitable for general lighting applications; while lighting means—were it not for the Class-3 provisions—would normally have to be fixtured.

Eighth, the 1984 National Electrical Code is published by National Fire Protection Association, Battery Park, Quincy, Mass. 02269.

Ninth, the 1984 National Electrical Code, and particularly Article 725 thereof, is herewith, by reference, made part of this specification.

Tenth, it is noted that each of the power conditioning units of FIGS. 1 and 2 may simply be considered as a remote electronic ballasting means for the fluorescent lamp in the lighting fixture to which it is connected.

It is believed that the present invention and its several attendant advantages and features will be understood from the preceeding description. However, without departing from the spirit of the invention, changes may be made in its form and in the construction and interrelationships of its component parts, the form herein described merely representing the presently preferred embodiment.

I claim:

1. A lighting system adapted to be powered from the relatively low frequency voltage on an ordinary electric utility power line, said system comprising:

a plurality of lighting fixtures non-permanently mounted at different locations at or near a mounting surface, each lighting fixture having: (a) a set of input terminals; (b) lamp means and (c) matching means connected between the input terminals and the lamp means, the matching means requiring for its proper operation that a relatively high frequency voltage be provided at the input terminals of the lighting fixtures; and for each lighting fixture:

(i) a power conditioning unit that is non-disconnectably connected with the power line and mounted at or near said mounting surface in a location within a relatively short distance from the lighting fixture, said power conditioning unit being operable to provide at a set of output terminals the relatively high frequency voltage required at the input terminals of said lighting fixture, and (ii) flexible cord means operable to provide disconnectable electrical connection between the input terminals of said lighting fixture and the output terminals of said power conditioning unit;

thereby permitting the lighting fixture to be moved and re-located relative to, as well as to be removed and/or disconnected from, its power conditioning unit.

2. The lighting system of claim 1 wherein the maximum power output available from the power line is of a magnitude that is regarded by an authoritative entity, such as the National Fire Protection Association, as being potentially unsafe from a fire initiation viewpoint, while the maximum power output available from the output terminals of said power conditioning unit is limited to a magnitude that is regarded by said authoritative entity as being acceptably safe from a fire initiation viewpoint.

3. The lighting system of claim 1 wherein the maximum power output available from the power line is substantially higher than 250 Volt-Ampere, while the maximum power output available from the output terminals of said power conditioning unit is on the order of 250 Volt-Ampere or less.

4. The lighting system of claim 1 wherein the electrical output characteristics of said power conditioning unit conform to the specification for Class-3 circuits as defined in Article 725 of the 1984 National Electrical Code.

5. The lighting system of claim 1 adapted for use with a suspended ceiling that is located underneath and suspended from a permanent ceiling, wherein said power conditioning unit is mounted onto said permanent ceiling and wherein said lighting fixture is mounted in said suspended ceiling.

6. The lighting system of claim 1 wherein at least one of said plurality of lighting fixtures comprises a fluorescent lamp.

7. The lighting system of claim 6 wherein said fluorescent lamp is ballasted by one of said power conditioning units.

8. The lighting system of claim 6 wherein said flexible cord means requires no more than two electrical conductors for proper operation of said fluorescent lamp.

9. The lighting system of claim 1 wherein said relatively high frequency voltage is of a frequency that is at least several times higher than that of the voltage on said power line.

10. A lighting system for a suspended ceiling, said lighting system being adapted to be powered from the relatively low frequency voltage on an ordinary electric utility power line, said suspended ceiling having a grid-structure and being suspended some distance underneath a permanent ceiling, said lighting system comprising:

a plurality of lighting fixtures mounted at different locations in said grid structure, each lighting fixture having: (a) a set of input terminals; (b) lamp means and (c) matching means connected between the input terminals and the lamp means, the matching means requiring for proper operation that a relatively high frequency voltage be supplied to said input terminals; and for each lighting fixture:

(i) a power conditioning unit that is non-disconnectably connected with said power line and mounted on said permanent ceiling at a location approximately above the lighting fixture, said power conditioning unit being operable to provide at a set of output terminals the relatively high frequency voltage required at the input terminals of said lighting fixture, and (ii) a flexible cord means operable to provide disconnectable electrical connection between the input terminals of said lighting fixture and the output terminals of said power conditioning unit.

11. The lighting system of claim 10 wherein the rate of energy output potentially available directly from said power line is considered by an authoritative entity, such as the National Fire Protection Association, as being non-safe from a fire initiation viewpoint, whereas the rate of energy output potentially available from the output terminals of said power conditioning unit is considered by said authoritative entity as being reasonably safe from a fire initiation viewpoint.

12. The lighting system of claim 10 wherein at least one of said plurality of lighting fixtures comprises a fluorescent lamp requiring for its proper operation a manifest current-limiting function, and wherein said manifest current-limiting function is provided by the power conditioning unit to which this one lighting fixture is connected.

13. A lighting system adapted to be powered from the relatively low frequency voltage of an ordinary electric utility power line and comprising:

a plurality of lighting fixtures, each lighting fixture having: (a) a set of input terminals; (b) lamp means and (c) matching means connected between the input terminals and the lamp means, the matching means being adapted to be properly operated only from a manifestly current-limited relatively high frequency voltage; and for each lighting fixture:

(i) a frequency-converting power-limiting means permanently connected with said power line and operable to provide at the set of output terminals the manifestly current-limited relatively high frequency voltage required by said lighting fixture, and (ii) flexible cord means operable to provide disconnectable electrical connection between the input terminals of said matching means and the output terminals of said frequency-converting power-limiting means.

14. The lighting system of claim 13 wherein the rate of energy output potentially available directly from said power line is considered by an authoritative entity, such as the National Fire Protection Association, as being non-safe from a fire initiation viewpoint, whereas the rate of energy output potentially available from the output terminals of said power conditioning unit is considered by said authoritative entity as being reasonably safe from a fire initiation viewpoint.

15. The combination comprising:

a suspended ceiling having a grid structure and being suspended some distance below a permanent ceiling;

a plurality of lighting fixtures adapted to be mounted at different locations in said grid structure, each one lighting fixture having: (a) a set of input terminals; (b) lamp means and (c) matching means connected between the input terminals and the lamp means, the matching means requiring for proper operation that an appropriate high frequency AC voltage be supplied to said input terminals; and for each one lighting fixture:

(i) a power conditioning unit that is: (a) permanently connected with the substantially non-current-limited voltage on an ordinary electric utility power line, and (b) located in the proximity of said one lighting fixture; said power conditioning unit being operable to provide at a set of output terminals a current-limited high frequency AC voltage that is appropriate to provide to the input terminals of said one lighting fixture, the frequency of said AC voltage being substantially higher than that of the voltage on said power line; and (ii) a flexible cord means operable to provide disconnectable electrical connection between the input terminals of said one lighting fixture and the output terminals of said power conditioning unit.

16. The combination of claim 15 wherein the electrical output available directly from said power line is considered by an authoritative entity, such as the National Fire Protection Association, as being hazardous from a fire-initiation viewpoint, whereas the electrical output potentially available from the output terminals of said power conditioning unit is considered by said authoritative entity as being substantially non-hazardous from a fire initiation viewpoint.

17. The combinaton of claim 15 wherein said at least one of said plurality of lighting fixtures comprises a fluorescent lamp requiring for its proper operation a manifest current-limiting function, and wherein said manifest current-limiting function is provided by the power conditioning unit to which this one fixture is connected.

18. The combination of claim 15 wherein said power conditioning unit may, safely and without causing any unreasonable degree of power dissipation, be left for an indefinite period of time without having any form of load connected with its output terminals.

19. The combination of claim 15 wherein said power conditioning unit comprises means operative to limit the magnitudes of its output voltage and output current without incurring substantive power dissipation.

* * * * *